United States Patent [19]

Walker

[11] Patent Number: 4,766,628

[45] Date of Patent: Aug. 30, 1988

[54] AIR MATTRESS WITH FILLER CHECK VALVE AND CAP THEREFOR

[76] Inventor: Robert A. Walker, 108A Commerce Dr., Greer, S.C. 29651

[21] Appl. No.: 16,566

[22] Filed: Feb. 19, 1987

Related U.S. Application Data

[63] Continuation-in-part of Ser. No. 819,937, Jan. 21, 1986, abandoned.

[51] Int. Cl.[4] ..... A47C 27/08; F16K 15/20

[52] U.S. Cl. ..... 5/449; 5/453; 5/455; 137/232

[58] Field of Search ..... 5/449, 453, 455, 451; 137/232, 234.5

[56] References Cited

U.S. PATENT DOCUMENTS

| | | | |
|---|---|---|---|
| 585,834 | 7/1897 | Ruth . | |
| 614,968 | 11/1898 | Mohs . | |
| 1,223,179 | 4/1917 | Kelly | 137/232 |
| 1,282,980 | 10/1918 | Takach . | |
| 1,453,721 | 1/1918 | Norwalk . | |
| 1,629,901 | 5/1927 | Ahearn . | |
| 2,033,512 | 5/1930 | Carliss . | |
| 2,044,913 | 6/1936 | Miller . | |
| 2,059,226 | 11/1936 | Gates . | |
| 2,068,266 | 1/1937 | Engel . | |
| 2,069,105 | 1/1937 | Engle . | |
| 2,119,687 | 6/1938 | Rexroad . | |
| 2,232,530 | 2/1941 | Hosking . | |
| 2,255,932 | 9/1941 | Kraft et al. . | |
| 2,309,430 | 1/1943 | Albert . | |
| 2,325,685 | 8/1943 | Keefe . | |
| 2,415,150 | 2/1947 | Stein . | |
| 2,549,597 | 4/1951 | Harris et al. . | |
| 2,664,104 | 12/1953 | Anderson . | |
| 2,691,179 | 10/1954 | Kann . | |
| 2,741,780 | 4/1956 | Kimbrig . | |
| 2,758,608 | 8/1956 | Sutcliffe . | |
| 2,810,922 | 10/1957 | Davis . | |
| 2,842,783 | 7/1958 | Druck . | |
| 2,998,817 | 9/1961 | Armstrong . | |
| 3,068,494 | 12/1962 | Pinkwater . | |
| 3,128,480 | 4/1964 | Lineback . | |
| 3,148,391 | 9/1964 | Whitney . | |
| 3,303,518 | 2/1967 | Ingram . | |
| 3,310,818 | 3/1967 | Fischer . | |
| 3,351,081 | 11/1967 | Bogossian et al. . | |
| 3,477,071 | 11/1969 | Emerson . | |
| 3,505,695 | 4/1970 | Bishaf et al. . | |
| 3,536,071 | 10/1970 | Ferrando . | |
| 3,590,851 | 7/1971 | Bogossian et al. . | |
| 3,605,138 | 9/1971 | Tucker . | |
| 3,784,994 | 1/1974 | Kery . | |
| 3,785,395 | 1/1974 | Andreasson . | |
| 3,790,975 | 2/1974 | Philipp et al. . | |
| 4,025,974 | 5/1977 | Lea et al. . | |
| 4,129,145 | 12/1978 | Wynn . | |
| 4,149,285 | 4/1979 | Stanton . | |
| 4,169,295 | 10/1979 | Darling . | |
| 4,175,297 | 11/1979 | Robbins et al. . | |
| 4,224,706 | 9/1980 | Young et al. . | |
| 4,225,989 | 10/1980 | Corbett et al. . | |
| 4,305,425 | 12/1981 | Mackal et al. . | |
| 4,371,999 | 2/1983 | Reid . | |
| 4,394,784 | 7/1983 | Swenson et al. . | |
| 4,470,164 | 9/1984 | Soderstrom et al. | 5/451 |
| 4,506,695 | 3/1985 | Kuypers | 137/234.5 X |

FOREIGN PATENT DOCUMENTS

| | | |
|---|---|---|
| 416104 | 10/1912 | France . |
| 790720 | 1/1956 | France . |
| 1338891 | 11/1973 | United Kingdom . |

*Primary Examiner*—Michael F. Trettel

*Attorney, Agent, or Firm*—Burd, Bartz & Gutenkauf

[57] ABSTRACT

An air mattress has a filler check valve connected to an air blower to supply air to the mattress chamber. A holder secured to the air mattress locates the filler check valve in a recessed position relative to an outer wall of the mattress. The filler check valve has a sleeve mounted on the holder and a rod attached to a valve head carrying an annular sealing member. A spring biases the valve head to a closed position wherein annular sealing member engages a beveled face on the inner end of the sleeve. The outer end of the sleeve has a cylindrical collar with internal and external threads. The internal threads of the collar engage external threads of the holder to secure the sleeve on the holder. A cap has an annular flange with internal threads of the collar to close an air passage in the sleeve. Seals located between the collar and sleeve and between the cap and the sleeve inhibit leakage of air from the chamber of the air mattress.

41 Claims, 3 Drawing Sheets

AIR MATTRESS WITH FILLER CHECK VALVE AND CAP THEREFOR

RELATED APPLICATION

This application is a continuation-in-part of U.S. Application Ser. No. 819,937 filed Jan 21, 1986, now abandoned.

FIELD OF INVENTION

The invention is directed to filler one-way valve providing a passage into an air receiving chamber and a one-way valve to prevent the air from flowing out of the chamber.

BACKGROUND OF INVENTION

Air mattresses are conventionally provided with short tubes that are connected to hoses for carrying air to mattress chambers. Plugs inserted into the ends of the tubes prevent the flow of air out of the air mattress chambers. The tubes are used with hoses connected to air pumps to allow air under pressure to be pumped into the air mattress chambers. One-way flat-type valves have been incorporated into the tubes to prevent reverse flow out of the air mattresses. Plugs snapped into the ends of the tubes are used in association with the flap valves to prevent leakage of air from the air mattresses. The tubes are attached directly to outside walls of the air mattresses. Another type of filler valve has a generally cup-shaped valve holder having a threaded tubular nipple. a valve body is threaded onto the nipple. The valve body has a flexible flap valve that allows air to flow into an air receiving chamber and prevents the air from flowing out of the chamber. When the valve is turned onto the nipple, it is permanently closed.

The prior art structures facilitate the introduction of air under pressure to an air mattress and like air receiving structures do not have valving and cap structures that are effective in eliminating leakage of air from the air mattresses. The prior one-way valves are not readily released so that the air in the air mattress can be evacuated. Air inflators cannot be used to open the valve structures so that air can be introduced into the air chamber or evacuated therefrom. The prior valve structures are not easily manufactured and assembled.

SUMMARY OF INVENTION

The invention is directed to an air mattress provided with a filler check valve assembly that is usable to permit air to be selectively introduced into the air mattress and vented from the air mattress. A cap is used to effectively seal the valve assembly so as to prevent any leakage of air from the air mattress. The air mattress has air impervious walls that surround a chamber that accommodates air under pressure. Air is supplied to the air mattress with the use of air blowers, pumps, and the like through a filler check valve assembly. The filler check valve assembly has a sleeve mounted in a holder secured to the wall of the air mattress. A valving means cooperates with the sleeve to allow air to flow into the chamber of the air mattress and block the lfow of air out of the chamber. The valving means can be moved to an open position to allow air to flow out of the chamber of the air mattress. A cap closes the outer end of the valving means to eliminate leakage of air from the air mattress.

The filler check valve assembly is mounted as a unit on the holder so that it can be separately constructed and tested before it is used on the air mattress. The holder has a tubular body with a passage for accommodating the sleeve of the check valve assembly. The sleeve has a smooth cylindrical outer surface to facilitate the insertion of the sleeve into the passage of the tubular body. An annular flexible wall joined to the tubular body is attached to the air mattress. The annular wall extends into the chamber of the body to hold the filler check valve assembly in a recessed position relative to the outside wall of the air mattress. The filler check valve assembly does not project outwardly from the outside wall of the air mattress. The filler check valve and cap do not interfere with the use of the air mattress. The functioning of the check valve and cap are not impaired by covers over the air mattress.

A preferred embodiment of the filler check valve and cap therefor has a cylindrical rigid sleeve having an inside wall surrounding an axial air passage. The sleeve has an inner end locatable in the chamber in the air mattress and an outer end in communication with the atmosphere. The sleeve has a cylindrical collar having internal and external threads. The internal threads of the collar engage external threads of a valve holder to secure the collar and the sleeve to the holder. An O-ring is located between the top of the holder and the collar. When the collar is threaded onto the holder, the collar is moved down into a tight relationship with the O-ring and the holder is wedged between the collar and the outer surface of the sleeve. A cap having an annular flange with internal threads that cooperate with the external threads of the collar is used to close the air passage. When the cap is threaded onto the collar, a flat seal member interposed between the base of the cap and the top of the collar is held in a close fitting relationship with the collar. The annular flange of the cap grips the collar to further wedge the valve holder between the collar and the outer surface of the sleeve. This effectively seals the filler check valve onto the valve holder to inhibit air from leaking from the air mattress. The inner end of the sleeve has an annular beveled face that cooperates with a valving member to close the air passage. The valving member is a disc or circular head carrying an annular seal adapted to be biased into sealing engagement with the annular face. A tubular guide is joined to the inner end of the sleeve and accommodates a linear rod. The upper end of the rod is attached to a spider head that slidably engages the inside wall of the sleeve. The guide and spider head control the linear movement of the valving member between its open and closed positions. A spring located about the rod engages the guide and spider head biasing the valving member to a closed position. The valving member can be moved to an open position by the application of pressure on the spider head after the cap has been removed from the collar. This allows air to be vented from the air mattress whereby the user can adjust the firmness of the air mattress. A tubular filler adaptor is used to move the valving member to an open position and allow air under pressure from an air blower pump or the like to be introduced into the chamber of the air mattress. As soon as the adaptor is removed from the filler check valve assembly the spring will bias the valving member to its closed position.

DESCRIPTION OF PREFERRED EMBODIMENT

Figure 1:
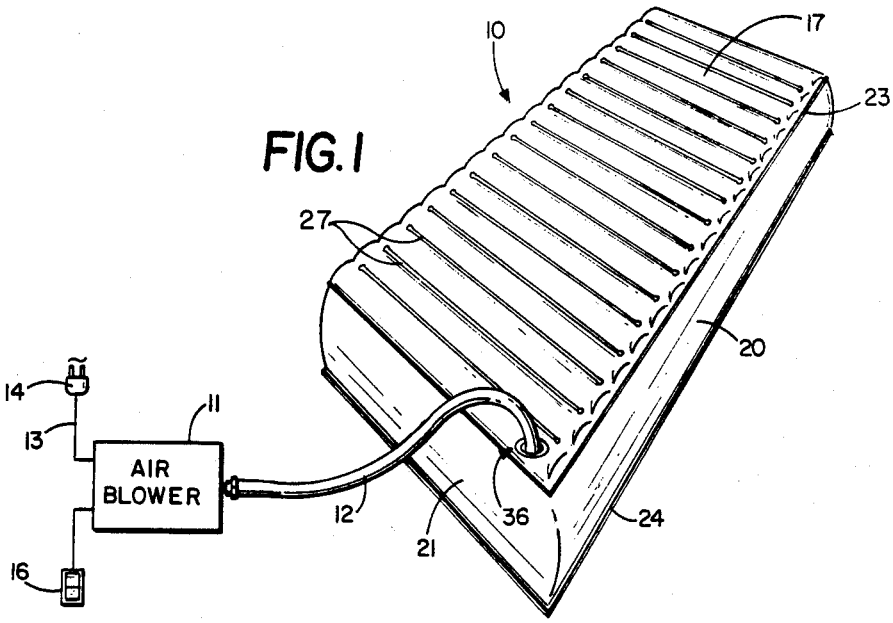
FIG. 1 is a perspective view of an air mattress equipped with the filler check valve of the invention in assembled relation with an air blower for supplying air under pressure to the air mattress.
Figure 10:
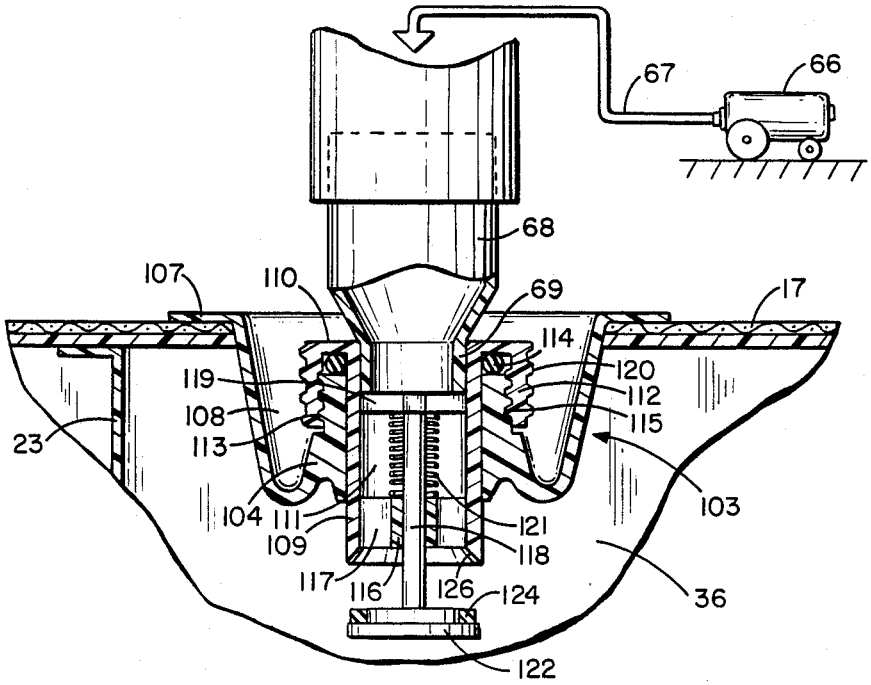
FIG. 10 is a sectional view similar to FIG. 4 showing the valve assembly open and coupled to an apparatus for supplying air to the air mattress.

Referring to FIG. 1, there is shown an air mattress indicated generally at 10 being inflated with an air blower 11. Air mattress 10 is usable in an air bed to support one or more persons. Air blower 11 has an electric motor driving a pump operable to deliver air through a hose 12 coupled to a filler check valve assembly indicated generally at 36 mounted on mattress 10. An electric motor (not shown) within air blower 11 is connected with an electrical conductor 13 and plug 14 to a source of electric power. A manually operated switch 16 controls the operation of the electric motor. Other air supply systems, such as a vacuum cleaner as shown in FIG. 10, or a manually operated pump can be used to supply air to air mattress 10.

Figure 2:
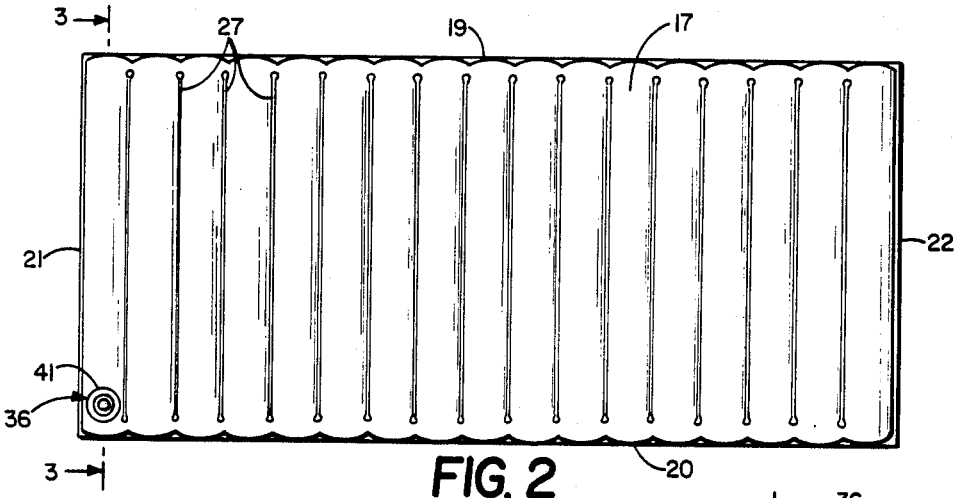
FIG. 2 is an enlarged top view of the air mattress of FIG. 1 without the air blower and a cap closing the check valve.
Figure 3:
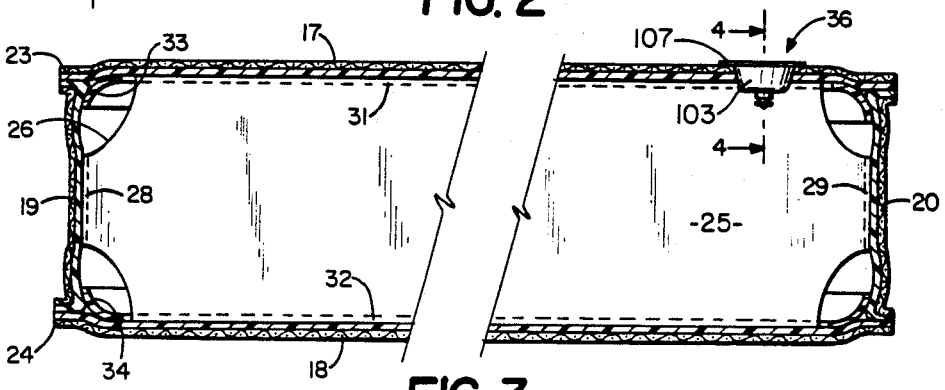
FIG. 3 is an enlarged foreshortened sectional view taken along the line 3—3 of FIG. 2.

Air mattress 10 has a generally rectangular top wall 17 located over a similar shaped bottom wall 18. Generally upright side walls 19 and 20 and end walls 21 and 22 are joined to the top and bottom walls 17 and 18 with the peripheral edge portions or seams 23 and 24 and define mattress chamber 25. Walls 17 to 22 are air impervious sheet members including an inner plastic sheet and an outer fabric sheet. As shown in FIG. 3, an upright web 26 extends transversely across chamber 25. Web 26 has top and bottom portions 31 and 32 secured to the top and bottom walls 17 and 18 and to opposite end portions 28 and 29 of side walls 19 and 20, respectively. Returning to FIGS. 1 and 2, a plurality of transverse seam lines 27 extend across top wall 17 of mattress 1. Corner strips 33 and 34 are bonded to the inside of seams 23 and 24.

Figure 4:
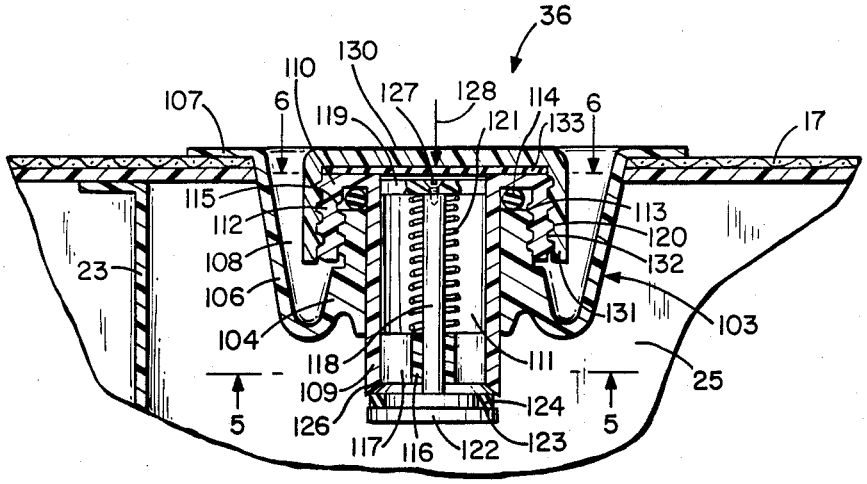
FIG. 4 is an enlarged sectional view taken along the line 4—4 of FIG. 3.

A filler check valve assembly 36 is located in a corner of top wall 17. As shown in FIG. 4, a holder indicated generally at 103 mounts filler check valve assembly 36 on top wall 17. Holder 103 has a generally upright tubular body 104 joined to an annular flexible wall 106. The upper end of annular wall 106 is secured to an outwardly directed lip 107. Lip 107 is secured with a heat seal to top wall 17. Annular wall 106 extends downwardly into mattress chamber 25 and provides a recess 108 for accommodating tubular body 104. Holder 103 locates the entire filler check valve assembly 36 below the plane of top wall 17. In other words, holder 103 and filler check valve assembly 36 projects into mattress chamber 25 as shown in FIG. 4. There is no obstruction above wall 17 that would interfere with the use of mattress 10. The filler check valve assembly 36 is in a concealed location which precludes inadvertent opening of the valve assembly.

Figure 5:
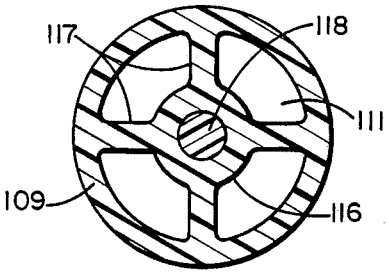
FIG. 5 is an enlarged sectional view taken along the line 5—5 of FIG. 4.
Figure 6:
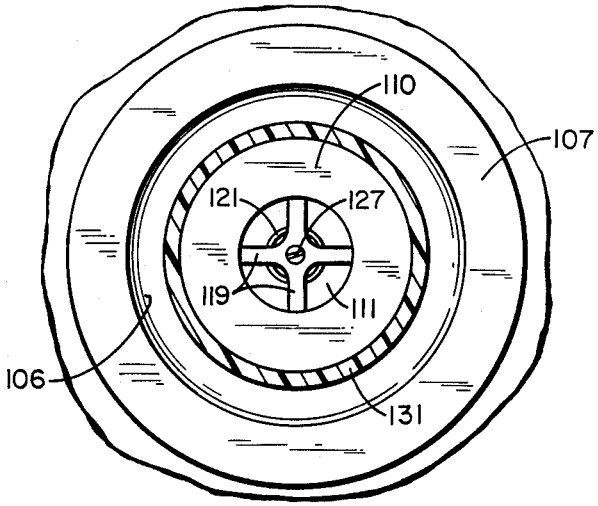
FIG. 6 is an enlarged sectional view taken along the line 6—6 of FIG. 4.
Figure 7:
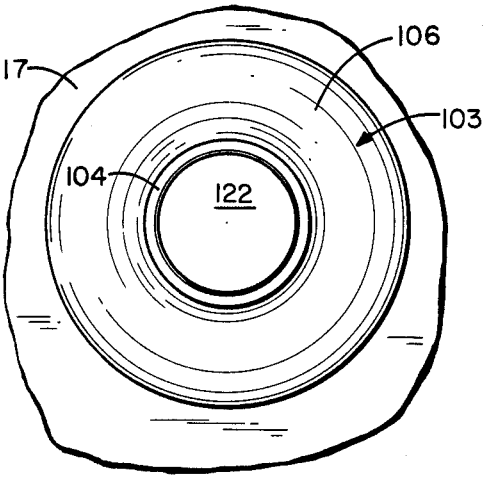
FIG. 7 is an enlarged bottom view of FIG. 4.
Figure 8:
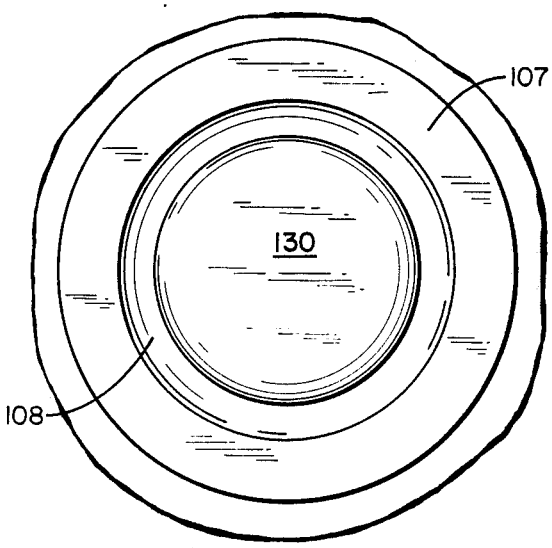
FIG. 8 is a top view of FIG. 4.

Filler check valve assembly 36 is a one-way valve allowing air to flow into air mattress chamber 24 from an air blower, vacuum cleaner apparatus or the like. As shown in FIG. 4, 5, and 6 valve assembly 36 has a cylindrical rigid sleeve 109 located in tight fit relation in tubular body 104. Sleeve 109 has a passage 111 to allow air to flow into and out of mattress chamber 25. A cylindrical collar 112 is attached to the upper end of sleeve 109. The body 104 has external threads 113 that cooperate with threads 115 on the inside of collar 112 to attach collar 112 and sleeve 109 to the tubular body 104. An O-ring 114 is interposed between the top of tubular body 104 and the juncture 110 of collar 112 and sleeve 109 to prevent air from escaping from chamber 24 between sleeve 109 and tubular body 104.

Figure 9:
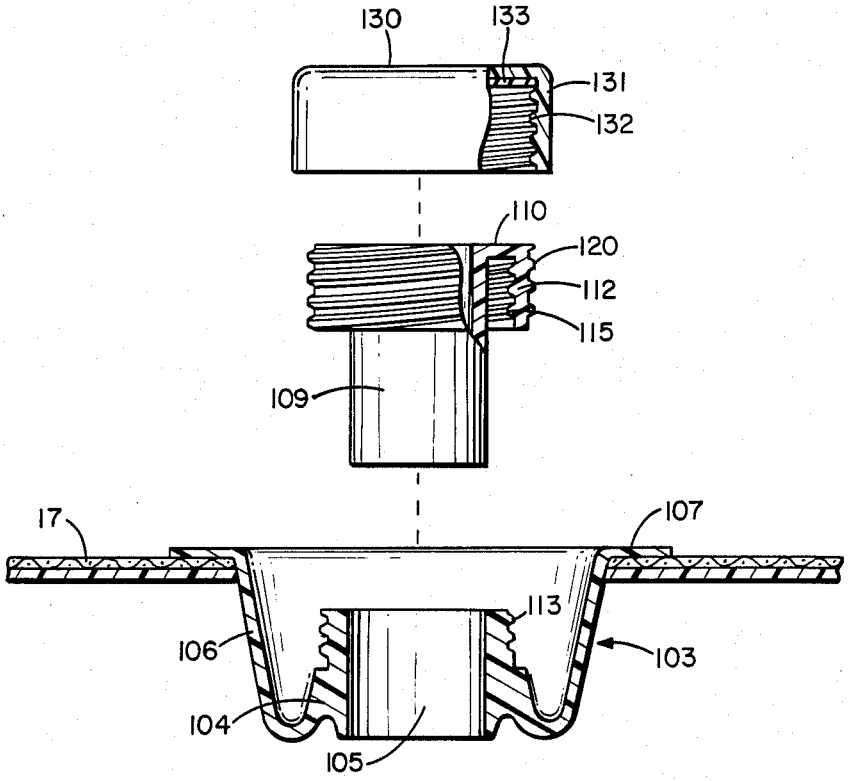
FIG. 9 is an exploded sectional view similar to FIG. 4 showing the cap, sleeve, and holder separate from one another.

As shown in FIG. 9, the inside wall 105 of the tubular body 104 is cylindrical and smooth to accommodate sleeve 109. The sleeve 109 has a smooth cylindrical outer surface that is located in a tight fit relation with respect to the inside surface 105 of tubular body 104. This permits sleeve 109 to be inserted into and taken out of tubular body 104 without cutting or destroying the tubular body 104 or taking the valve apart. This facilities the assembly of the valve on air mattress 10. The smooth cylindrical inside and outside surfaces of body 104 and sleeve 109 respectively permit the rotation of sleeve 109 relative to body 104 so that collar 112 can be firmly threaded onto body 104 thereby wedging body 104 between collar 112 and sleeve 109.

Returning to FIG. 4, the lower portion of sleeve 109 has a central tubular guide 116. As shown in FIG. 5, a plurality of arms 117 attach guide 116 to sleeve 109. Arms 117 are circumferentially spaced from each other to allow air to flow through passage 111. A rod 118 is slidably positioned in guide 116 and attached at its upper end to a spider head 119 are slidably engageable with the inside surface of sleeve 109 whereby sleeve 109 and tubular guide 116 allow linear movement of rod 118. This prevents the cocking and misalignment of rod 118 in the sleeve 109. A circular valving head 122 is integral with the lower end of rod 118. Head 122 has on its upper side an annular groove 123 accommodating an annular seal member 124. Seal member 124 is adapted to be located in surface engagement with a beveled surface 126 on the lower end of sleeve 109. A coil spring 121 located about rod 118 and engageable with the tubular guide 116 and spider 119 biases valving head 122 into a closed position as shown in full lines in FIG. 4. Valving head 122 can be moved to an open position by applying downward pressure on the spider head 119 as shown by the arrow 128. This releases the annular seal member 124 from the beveled surface 126 and allows air under pressure to flow from chamber 25 via passage 111 to the atmosphere.

The outer surface of collar 112 has external threads 120 accommodating a cup-shaped cap 130. Cap 130 has an annular cylindrical flange 131 having internal threads 132 that cooperate with external threads 120 to hold the cap on collar 112. A flat seal member 133 is interposed between the base of cap 130 and the top of juncture 110. When cap 130 is threaded onto collar 112, seal member 133 is held in a tight relationship with the top of juncture 110. Flange 131 holds collar 112 and tubular body 104 in a tight fit relationship with the outer surface of sleeve 109. This effectively seals valve assembly 36 onto tubular body 104 so as to prevent any leakage of air from mattress chamber 25.

Referring to FIG. 10, there is shown valve assembly 36 in the open position to discharge air under pressure into mattress chamber 25. Cap 130 has been removed. A vacuum cleaner 66 provides a source of air under pressure. The air is delivered through a hose 67 to a tubular adaptor 68. The adaptor 68 slides into the free end of vacuum cleaner hose 67. Adaptor 68 has a reduced diameter nipple or end 69 that fits into the top of passage 111. When adaptor 68 is pushed into sleeve 109, the spider head 119, rod 118, and the valving head 122 are moved down thereby opening the valve. The air flows through adaptor 68, and passage 111 into the mattress chamber 25. As soon as adaptor 68 is removed from sleeve 109, spring 121 will immediately close the head 122 and hold seal 124 in tight sealing engagement with beveled end face 126.

While there has been shown and described a preferred embodiment of the filler check valve assembly of the invention a used with an air mattress, it is understood that changes in the parts and arrangement of structure can be made by those skilled in the art without departing from the invention. The invention is defined in the following claims.

The embodiments of the invention in which an exclusive property or privilege is claimed are defined as follows:

1. An air mattress comprising: air impervious wall means surrounding a chamber for accommodating air under pressure, filler check valve assembly for use in selectively supplying air under pressure to said chamber and venting air from said chamber, holder means mounting said filler check valve assembly on said wall means, said holder means having a tubular body and an annular flexible wall joined to the body to locate the check valve assembly in said chamber, and means securing said annular flexible wall to said wall means, said tubular body having a smooth inside cylindrical surface, said surface having a uniform diameter, said valve assembly having a sleeve with an inside tubular surface surrounding an air passage open to said chamber and externally of the air mattress mounted on the tubular body, said sleeve having a smooth outside cylindrical surface having a uniform diameter located in a tight fit relationship with the inside cylindrical surface of the tubular body, said sleeve having a collar to cooperate with the tubular body to mount the sleeve on the body in a tight fit relation with the inside surface of the body, said collar comprising an outwardly directed annular flange secured normally to the sleeve and a cylindrical side wall extending downwardly from the flange, valving means movably mounted on the sleeve operable to open and close the air passage, said valving means including head means located in said chamber engageable with the sleeve to close said passage, a rod secured to said head means projected axially into said passage, a tubular guide joined to said sleeve slidably accommodating said rod, a spider head secured to the rod having outer end portions slidably engageable with the inside tubular surface of the sleeve, biasing means engageable with said tubular guide and spider head for holding the head means in a closed position, said valving means being movable against the force of the biasing means to open said air passage thereby allowing air to flow out of the chamber, and a cap means mounted on the cylindrical side wall of the collar for closing air passage in said sleeve.

2. The mattress of claim 1 wherein: said sleeve has an inner end having an annular face, said head means being engageable with said annular face to close said air passage in said sleeve.

3. The mattress of claim 2 wherein: said annular face has an inside annular beveled face.

4. The mattress of claim 1 wherein: said tubular body has an annular outer end, said outwardly directed annular flange located adjacent said annular outer end, and annular seal means located between said outer end of the body and flange.

5. The mattress of claim 1 wherein: said tubular body has external threads thereon, said cylindrical side wall having internal threads adapted to cooperate with the external threads to mount the sleeve on the body in a tight fit relation with the inside surface of the body.

6. The mattress of claim 1 wherein: said tubular guide has a hole, said rod being slidably positioned through said hole.

7. The mattress of claim 1 wherein: said tubular body has an outer end and external threads thereon, said cap means having a downwardly extending annular flange with internal threads thereon, said sleeve having an outer end, said collar secured to said outer end of the sleeve, said side wall of the collar having internal threads cooperating with said external threads on the body to hold the sleeve on the tubular body, said side wall having external threads cooperating with said internal threads of the downwardly extending flange of the cap means to hold the cap means on the sleeve, whereby the cap means closes the air passage in said sleeve.

8. The mattress of claim 7 including: seal means located between said outer end of the body and the outwardly directed flange whereby when said collar is threaded on said tubular body the seal means prevents escape of air from the chamber of the air mattress.

9. The mattress of claim 7 wherein: said sleeve has an inner end having an annular face, said head means being engageable with said annular face to close said valve assembly.

10. The mattress of claim 9 wherein: said annular face has an inside annular beveled face.

11. An air mattress and filler check valve assembly for selectively allowing air to be introduced into and vented from the air mattress comprising: air impervious top and bottom walls and side walls secured to the top and bottom walls surrounding a chamber for accommodating air under pressure, one-way valve means usable to supply air under pressure to said chamber and vent air from said chamber, holder means mounting said valve means on one of said walls, said holder means having a tubular body with a smooth cylindrical inside surface having a uniform diameter open to the chamber and externally of the air mattress, said valve means having a sleeve with a smooth cylindrical outside surface having a uniform diameter located in a tight fit relation with the inside cylindrical surface of the tubular body, said sleeve having a collar to cooperate with the tubular body to mount the sleeve on the body in a tight fit relation with the inside surface of the body, said collar comprising an outwardly directed annular flange secured normally to the sleeve and a cylindrical side wall extending downwardly from the flange, said sleeve having an inside wall surrounding an air passage, an inner end, and an outer end open to said air passage, said inner end having an annular face, a tubular guide joined to the sleeve adjacent the inner end of the sleeve, an elongated rod slidably located through the tubular guide, first head means secured to the rod slidably engaging the inside wall of the sleeve, said first head means having at least one opening allowing air to flow through the air passage, second head means secured to said rod locating said second head means adjacent the face on the inner end of the sleeve, said first head means and guide allowing the rod to be linearly moved to selectively move said head means between open and closed positions relative to the annular face on the sleeve, biasing means engaging the guide and first head means to bias the second head means in a direction for holding the second head means against the annular face of the sleeve to close the air passage, said second head means being movable away from the annular face of the sleeve against the force of the biasing means to open said air passage, and cap means mounted on the side wall of the collar for closing the air passage in the sleeve.

12. The assembly of claim 11 wherein: said first head means has a plurality of spider arms with ends, said ends of the arms being slidably engageable with the inside wall of the sleeve whereby said spider arms and guide controls the linear movement of the second head means between its open and closed positions.

13. The valve assembly of claim 11 wherein: said second head means comprises a disc, said disc having an annular groove, an annular seal located in said groove, said seal engageable with the annular face when the second head means is in the closed position.

14. The valve assembly of claim 13 wherein: said annular face is an annular beveled face.

15. The mattress and filler check valve assembly of claim 11 wherein: said tubular body has an outer end and external threads thereon, said side wall having internal threads cooperating with said external threads on the body to hold the sleeve on the tubular body, said cap means having a downwardly extending annular flange with internal threads, said side wall having external threads cooperating with the internal threads on the downwardly extending flange to mount said cap means on the sleeve.

16. The air mattress and filler check valve assembly of claim 15 including: seal means located between the cap means and the outer end of the sleeve whereby the cap means is threaded on the collar and the seal means inhibits escape of air from the chamber of the air mattress.

17. The air mattress and filler check valve assembly of claim 15 including: seal means located between said outer end of the body and outwardly extending flange whereby when said collar is threaded on said tubular body, and the seal means inhibits escape of air from the chamber of the air mattress.

18. The air mattress and filler check valve of claim 11 wherein: said holder means included an annular flexible wall joined to the tubular body extended into the chamber providing a recess for the body to locate the check valve assembly in said chamber, and means securing said annular flexible wall to one of said walls of the air mattress.

19. A filler check valve assembly and holder for use in selectively allowing air to be introduced into and vented from an air mattress comprising: a sleeve having a smooth cylindrical outside surface and an inside wall surrounding an air passage, an inner end, and an outer end open to said air passage, said inner end having an annular face, a tubular guide joined to the inner end of the sleeve, a rod slidable located through said guide, first head means secured to the rod slidably engaging the inside wall of the sleeve, said first head means having at least one opening allowing passage of air through the air passage, second head means secured to said rod locating the second head means adjacent the face on the inner end of the sleeve, said first head means and guide allowing the rod to be moved to selectively move said second head means between open and closed positions relative to the annular face on the sleeve, biasing means engaging the guide and first head means to bias the second head means in a direction holding the second head means in a closed position against the annular face of the sleeve, said second head means being moved away from said annular face to an open position against the force of the biasing means, a tubular body having a smooth cylindrical inside surface surrounding a passage, said sleeve being located in said passage with the outside surface of the sleeve being in tight fit relation with the inside surface of the tubular body, an annular wall joined to said tubular body adapted to mount the tubular body and filler check valve assembly on an air mattress, and a cup-shaped cap for closing the air passage in said sleeve, said tubular body having external threads, said sleeve having a collar located over said tubular body, said collar comprising an outwardly directed annular flange secured normally to the outer end of the sleeve and a cylindrical side wall extending downwardly from the outwardly directed flange, said side wall having internal threads cooperating with the external threads on the body to mount said sleeve on said tubular body, said cap having a downwardly extending annular flange with internal threads thereon, said side wall having external threads cooperating with said internal threads of the downwardly extending flange to hold the cap on the collar whereby the cap closes the air passage in said sleeve.

20. The structure of claim 19 including: seal means located between said outwardly directed flange and the body to mount the sleeve in sealing relation on the tubular body.

21. A filler check valve assembly and mount for inflating and delating an air mattress comprising: a cylindrical sleeve having a smooth cylindrical outside surface having a uniform diameter from an inner end to an outer end, and an inside wall surrounding an axial air passage, a tubular guide integral with the inner end of the sleeve, radial arms securing the guide to the sleeve, an elongated linear rod slidably located within the guide, said rod having an inner end and an outer end, a circular head having an annular groove to accommodate an annular seal, an annular face located on the inner end of the sleeve, a spider head secured to the outer end of the rod, said spider head having ends located in slidable contact with the inside wall of the sleeve, the spider head and the guide allowing the rod to be linearly moved to selectively move the circular head between open and closed positions relative to said annular face, a coil spring surrounding the rod and engaging the guide and the spider head, said spring biasing the circular head in an outward direction and holding the seal in engagement with said face to close the passage, a tubular body having a smooth cylindrical inside surface having a uniform diameter surrounding a passage, said sleeve being located in said passage with the outside surface of the sleeve being in tight fit relation with the inside surface of the tubular body, said sleeve having a collar to cooperate with the tubular body to mount the sleeve on the body in a tight fit relation with the inside surface of the body, said collar comprising an outwardly directed annular flange secured normally to the sleeve and a cylindrical side wall extending downwardly from the flange, a flexible annular wall secured to said tubular body adapted to be attached to a side of the air mattress, said annular wall having a generally cup shape providing a recess for accommodating the tubular body and to conceal the valve assembly, and a cup-shaped cap mounted on the side wall of the collar for closing the air passage in the sleeve.

22. The structure of claim 21 wherein: said annular face has an inside annular beveled face.

23. The structure of claim 21 wherein: the tubular body has external threads, said collar located over the said tubular body, said side wall having internal threads cooperating with the external threads on the body to mount said sleeve on said tubular body, said cap having a downwardly extending flange with internal threads, said side wall having external threads cooperating with the internal threads on the downwardly extending flange to mount said cap on the sleeve.

24. The structure of claim 23 including: seal means located between the cap and sleeve to locate the cap in sealing relation on the sleeve whereby when said cap means is threaded on the collar the seal means inhibits the escape of air through the air passage in the sleeve.

25. The structure of claim 23 including: seal means located between said outwardly directed flange and body to locate the sleeve in sealing relation on the tubular body whereby when said side wall is threaded on said tubular body the seal means inhibits the escape of air between the sleeve and tubular body.

26. An air mattress comprising: air impervious first and second wall means surrounding a chamber for accommodating air under pressure, a filler check valve assembly for use in selectively supplying air under pressure to said chamber and venting air from said chamber, holder means, said holder means having a tubular body and an annular flexible wall joined to said tubular body and extended into said chamber from said wall means toward said second wall means providing a recess for the body to locate the check valve assembly inwardly of first wall means in said chamber, said flexible wall having an inner end located within the chamber secured to said tubular body, and means securing said annular flexible wall to said first wall means, said tubular body having a smooth inside cylindrical surface having a uniform diameter and an inner portion located within said chamber adjacent said inner end of said flexible wall, said valve assembly having a sleeve with an inside tubular surface surrounding an air passage open to said chamber and externally of the air mattress mounted on the tubular body, said sleeve having a smooth outside cylindrical surface having a uniform diameter from an inner end to an outer end located in a tight-fit relation with the inside cylindrical surface of the tubular body, said sleeve having a collar to cooperate with the tubular body to mount the sleeve on the body in a tight fit relation with the inside surface of the body, said collar comprising an outwardly directed annular flange secured normally to the sleeve and a cylindrical side wall extending downwardly from the flange, said sleeve having its inner end projected into said chamber from the inner portion of the tubular body toward the second wall means to maintain a space between the second wall means and said inner end flexible wall and inner portion of the tubular body to facilitate the flow of air into and out of said chamber, valving means movably mounted on the sleeve operable to open and close the air passage, said valving means including a head means located in said chamber engageable with the sleeve to close said passage, a rod secured to said head means projected axially into said passage, a tubular guide joined to said sleeve slidably accommodating said rod, a spider head secured to the rod having an outer end portion slidably enageable with the inside tubular surface of said sleeve whereby said valving means is guided for open and closing movements by the tubular guide and inside tubular surface of the sleeve, and biasing means engageable with said tubular guide and spider head for holding the head means in a closed position, said valving means being movable against the force of the biasing means to open said air passage thereby allowing air to flow out of the chamber.

27. The mattress of claim 26 wherein: said sleeve has an annular face on the inner end thereof, said head means being engageable with said annular face to close said air passage in said sleeve.

28. The mattress of claim 26 wherein: said tubular body has an annular outer end, said outwardly directed annular flange located between said outer end of the body and flange.

29. The mattress of claim 26 wherein: said tubular body has external threads thereon, the side wall having internal threads adapted to cooperate with the external threads on said body to mount the sleeve on said body.

30. The mattress of claim 26 wherein: said tubular body has an outer end and external threads thereon, said outwardly directed flange secured to said outer end of the sleeve, said side wall having internal threads cooperating with said external threads on the body to hold the sleeve on the tubular body, and seal means located between said outer end of the body and outwardly directed flange whereby when said collar is threaded on said tubular body, the seal means inhibits the escape of air from the chamber of the air mattress.

31. The mattress of claim 26 including: cap means for closing the external end of said passage in said sleeve.

32. An air mattress and filler check valve assembly for selectively allowing air to be introduced into and vented from the air mattress comprising: air impervious top and bottom walls surrounding a chamber for accommodating air under pressure, valve means usable to supply air under pressure to said chamber and vent air from said chamber, holder means mounting said valve means on one of said walls, said holder means having a tubular body with a smooth cylindrical inside surface having a uniform diameter open to the chamber and externally of the air mattress, said valve means having a sleeve with a smooth cylindrical outside surface having a unifrom diameter from an inner end to an outer end located in tight fit relation with the inside cylindrical surface of the tubular body, said sleeve having a collar to cooperate with the tubular body to mount the sleeve on the body in a tight fit relation with the inside surface of the body, said collar comprising an outwardly directed annular flange secured normally to the sleeve and a cylindrical side wall extending downwardly from the flange, said sleeve having an inside wall surrounding an air passage, said inner end located in said chamber inwardly of said tubular body to separate the top and bottom walls from each other and from said tubular body and holder means, and said outer end being open to said air chamber, said valve means having a valving member movable to open and closed positions operable to selectively open and close said passage to regulate the flow of air into and out of said chamber, and biasing means engaging said valving member for holding the valving member in said closed position, said valving member being movable to said open position against the force of the biasing means to open said air passage in said sleeve.

33. The mattress of claim 32 wherein: said sleeve has an annular face on the inner end thereof, said valving member being engageable with said annular face to close said air passage in said sleeve.

34. The mattress of claim 32 wherein: said tubular body has an annular outer end, said outwardly directed annular flange located adjacent said annular outer end, and annular seal means located between said outer end of the body and flange.

35. The mattress of claim 32 wherein: said tubular body has external threads thereon, said side wall having internal threads adapted to cooperate with the external threads on said body to mount the sleeve on said body.

36. The mattress of claim 32 wherein: said tubular body has an outer end and external threads thereon, said outwardly directed flange secured to said outer end of the sleeve, said side wall having internal threads cooperating with said external threads on the body to hold the sleeve on the tubular body, and seal means located between said outer end of the body and outwardly directed flange whereby when said collar is threaded on said tubular body, said seal means inhibits escape of air from the chamber of the air mattress.

37. The mattress of claim 32 including: cap means for closing the external end of said passage in said sleeve.

38. A filler check valve assembly and holder for mounting the valve assembly on a wall of an air mattress, said wall surrounding a chamber for accommodating air under pressure, said valve assembly being usable to selectively allow air to be introduced into and vented from the chamber comprising: a sleeve having an inside wall surrounding an air passage to allow air to flow into and be vented from the chamber of an air mattress and an outside surface having a uniform diameter from an inner end to an outer end open to said air mattress, valve means located within said passage to control the flow of air into and out of said chamber, said valve means having a valving member movable to an open position to allow air to flow through said passage into said chamber and allow air to flow from said chamber through said passage to atmosphere, said valving member being movable to a closed position to block the flow of air through said passage, biasing means engagable with said valving member to bias the valving member to its closed position, said valving member being movable from the closed position to an open position against the force of the biasing means, a tubular body having an inside surface having a uniform diameter surrounding a passage and an inner end, said sleeve being located in said passage of the tubular body with the outside surface of the sleeve in a tight fit relation with said inside surface of the tubular body, said sleeve having a collar to cooperate with the tubular body to mount the sleeve on the body in tight fit relation with the inside surface of the body, said collar comprising an outwardly directed annular flange secured normally to the sleeve and cylindrical side wall extending downwardly from the flange, said inner end of the sleeve projected inwardly from the inner end of the tubular body into said chamber, and an annular wall joined to said tubular body adapted to mount the tubular body and filler check valve assembly carried by said tubular body on the wall of an air mattress.

39. The structure of claim 38 wherein: said outwardly directed annular flange is secured to the outer end of the sleeve, said flange extended over the outer end of the tubular body, and seal means interposed between the flange and the outer end of the tubular body.

40. The structure of claim 38 wherein: the tubular body has external threads, said collar located over said tubular body, said side wall having internal threads cooperating with the external threads of the body to mount said sleeve on said body, and seal means located between said outwardly directed flange and the body.

41. The structure of claim 38 including: cap means for closing the external end of said passage in said sleeve.

* * * * *